United States Patent [19]

Ruzand et al.

[11] 4,244,282

[45] Jan. 13, 1981

[54] BOX ERECTING APPARATUS

[75] Inventors: André E. Ruzand, Voiron; Francois L. Ernst, La Murette, both of France

[73] Assignee: Etablissements Ruby, Voiron, France

[21] Appl. No.: 59,521

[22] Filed: Jul. 23, 1979

[30] Foreign Application Priority Data

Jul. 25, 1978 [FR] France ..... 78 21971
Jul. 16, 1979 [FR] France ..... 79 18391

[51] Int. Cl.[3] ..... B31B 1/76

[52] U.S. Cl. ..... 493/23; 53/566; 53/376; 493/124; 493/137

[58] Field of Search ..... 93/53 R, 53 LF, 53 BF, 93/53 SD, 53 AC; 53/376, 566

[56] References Cited

U.S. PATENT DOCUMENTS 2,749,818 6/1956 Bivans ..... 93/53 R
3,412,652 11/1968 McIntyre ..... 93/53 AC

*Primary Examiner*—Travis S. McGehee
*Attorney, Agent, or Firm*—Brisebois & Kruger

[57] ABSTRACT

A machine for erecting flat box blanks and for closing one end of the erected box comprises a feed guide dimensioned to receive a stack of flat-folded blanks, and a forming slot at an end of the feed guide, the forming slot being dimensioned to receive an erected box but consequently too small to accept a flat-folded blank. A suction head carried by a drive jack is effective to pull a box blank from the feed guide into the forming slot, with simultaneous erection of the blank to form the rectangular box, and immediately after that two folding blades converge on the box to fold-in side flaps ready for folding down an end flap of the box. The folding of the end flap is accomplished by a closing fork operating in a direction perpendicular to the plane of action of the closing blades and effective to fold over both an end panel, and a terminal tab which tucks into the box to ensure closing.

24 Claims, 7 Drawing Figures

BOX ERECTING APPARATUS

BACKGROUND OF THE INVENTION

It is known that in numerous fields such as, for example, cosmetics, perfumery or pharmacy, products such as small capacity bottles are, because of their small size, grouped together so as to market them in assemblies each comprising a plurality of products. For this purpose, folding boxes are most commonly used, which are supplied flat for reasons of bulk. These boxes are pre-cut and have pre-determined folding edges so that they can be erected by simple folding without requiring a glueing or stapling operation.

It is also known that this type of cardboard packaging must conform to various requirements, which include low cost, because these folding cardboard packages are generally used as one-way packaging. This problem is partially solved by selecting inexpensive materials such as compact or corrugated cardboard, but it also depends on the box manufacturing steps.

It is an object of the present invention to provide a device which makes it possible to mechanise the use of folding boxes or cases of the type which are supplied flat and are capable of being closed at least at one of their two ends. More precisely, the present invention proposes to produce a device which makes it possible to carry out automatically a sequence of two successive operations, namely a first operation in which the box is formed, so as to convert its original flat configuration to a substantially parallelepiped shape, and a second operation of closing one of the ends of the box thus formed.

BRIEF DESCRIPTION OF THE INVENTION

Accordingly, the present invention provides a device for forming folding boxes from flat box blanks made of cardboard or of a similar semi-rigid material and then to close one of their ends, said formed boxes defining a case having four folding edges which run parallel to the axis of the case and which define four panels, namely a first pair consisting of a lower panel and an opposite upper panel and a second pair consisting of two lateral panels, at least that end of the case which it is desired to close having on the one hand an end panel connected by a folding line to one of said upper and lower panels of the case, and on the other hand two transverse flaps which are each connected by a folding line to a respective said lateral panel of the case, the said end panel being extended by a tab intended to be introduced into the case of the formed box, said device comprising:

(a) feed means adapted to receive the flat box blanks stacked on top of one another with the ends of the boxes which it is desired to close all being arranged on the same side of said feed means;

(b) means defining a forming slot of U-shaped cross-section having a top and a bottom and an axis extending between first and second open ends, said first end being designed to pass a completed box after the forming and closing cycle;

(c) means effective to fold over the said two end flaps of the formed box towards one another inside the forming slot, and to arrange them substantially in one and the same plane;

(d) closing means to pivot the end panel and engage its associated tab with the interior of the case of the box; and (e) means operable to move said closing means translationally parallel to the axis of said forming slot, said closing means being arranged opposite said second opening.

It is preferred that in the flat box blanks stacked inside the feeder, the end panel to be positioned is connected to the upper panel of the box cases.

In an advantageous embodiment, a double-action jack is provided for feeding into the forming slot the box blanks to be erected, the head of which jack can be moved in an alternating translational movement. The bottom of the forming slot has an orifice through which the head of the above-mentioned jack passes. The head of the box blank feed jack can assume two positions at the end of its stroke, namely a retracted position where it substantially constitutes the extension of the bottom of the forming slot and a protruded position where it substantially constitutes the extension of the top of the forming slot. The head of the box blank feed jack is provided with at least one suction member which makes it possible to hold the lower panel of a box blank in the feed means onto the head of the jack by a partial vacuum. The suction signal is advantageously triggered when the piston rod of the jack reaches its extended position, suction being continued at least until the head of the box blank feed jack reaches its retracted position.

The members for folding over the two end flaps of the boxes which are to be closed comprise two substantially co-planar blades which can be brought together or moved apart, the plane of movement of the said blades running at right angles to the guide arms forming side walls of the forming slot. The two above-mentioned folding-over blades can assume two positions relative to one another at the end of a stroke: on the one hand a separated position in which the two blades are located on either side of the forming slot, and on the other hand a close position in which the two blades protrude into the slot through two windows machined in the two guide arms of the said slot. The movement of the two folding-over blades is effected by means of a further double-action jack, of which the movable rod acts directly on one of the two above-mentioned blades. The other folding-over blade is driven via an oscillating small connecting rod mounted to rotate about a fixed axis, on which rod acts a transmission arm mechanically connected to the rod of the folding-over jack.

The actuating signal to the jack in question to be used for folding over the end flaps of a box which is to be closed, is advantageously given at the instant at which the box blank feed jack for introducing a box into the forming slot reaches its retracted position. Equally, the actuating signal for stopping the suction is given at the instant at which the two folding-over blades, after having been in the separated position, reach their close relative position.

The closing members are advantageously carried by a slide which can be caused to undergo an alternating translational movement parallel to the axis of the forming slot. The slide, which carries the closing members, can assume two positions at the end of its stroke, namely a first position remote from the forming slot, and a second position close to the forming slot with the closing members coming substantially to rest against the two folding-over blades in the close position. The slide which carries the closing members is actuated by a control jack operated at the instant at which the two blades for folding over the end tabs reach their close relative position, whilst the jack which controls the two folding-over blades is manoeuvred so as to cause the blades to move from a close relative position to a separated relative position at the instant at which the slide reaches its close position.

In a first embodiment of the closing members the closing members comprise a fork of which the two arms, when the slide is in the close position, are located inside the forming slot and on either side of the two folding-over blades whilst the bottom of the fork has a concave profile substantially abutting against the above-mentioned folding-over blades. The closing fork is intended to cause the box end panel and its associated tab, to pivot in the clockwise direction in order to bring them into a position where the end panel is at a slight angle relative to a plane perpendicular to the guide arms of the forming slot, and where the tab is substantially arranged opposite its slit for introduction into the case.

In this first embodiment, the closing members furthermore comprise pushing means which act on the end panel of a box to be closed when the closing fork comes to rest with its incurved-profiled bottom against the two folding-over blades in the close position for the purpose of introducing the flap into the box. The closing fork can move in opposition to a spring relative to the slide which supports the fork. The axis of movement of the fork relative to the above-mentioned slide is parallel to the axis of movement of the slide relative to the framework which supports the slide. The pushing means are fixed onto the slide. The two arms of the closing fork are substantially parallel and at right angles to the two guide arms of the forming slot. The concave-profiled bottom of the closing fork consists of profiled fins uniformly spaced apart from one another and connected at right angles to the upper arm of the fork. The profiled fins are extended parallel to the upper arm of the closing fork by co-planar strips which constitute the lower arm of the said fork.

Advantageously, the pushing means are in the form of parallel teeth uniformly spaced apart from one another, between which teeth can move the profiled fins of the closing fork; these teeth define, opposite the forming slot, a support surface which is substantially planar and runs at right angles to the two guide arms. In this first embodiment, the finished boxes, that is to say the boxes which have been erected and closed, are preferably removed manually. It is found that the device according to the invention permits the folding boxes to be produced with a high cycle speed, which cycle speed matches the rhythm of the operator because the cycle for obtaining a new ready-to-use box is triggered by the operator himself when he extracts from the device the box which has just been produced.

In a second embodiment of the closing members, the closing fork by itself makes it possible, by virtue of its particular shape, to carry out the complete closing of the erected boxes inside the forming slot without involving pushing means, that is to say to effect the complete introduction of the flap into the case and the bringing of the end panel into contact with the edge of the case in a plane perpendicular to the axis of the said case. Furthermore, in this second embodiment, the removal of the finished boxes from the forming slot is no longer carried out manually, but instead automatically by means of an ejector jack. The ejector jack acts on the closed side of the boxes and consequently makes it possible, where appropriate, to complete the closing operation carried out by the closing fork by firmly pressing the folded-over end panel against the edge of the case.

In this second embodiment, the slide on which the closing fork is located also carries the ejector jack which serves to eject the boxes from the forming slot, this jack being actuated after closure of the box inside the forming slot, and after retraction of the folding-over blades from the said slot. The closing fork is carried relative to the forming slot at the front of the slide, whilst the removal jack is carried at the rear of the said slide, the closing fork being provided with a passage in which the rod of the removal jack can slide. The removal jack is actuated at the instant at which the slide is at the end of its stroke after the two folding-over blades have been withdrawn from the forming slot, the rod of the jack having a sufficient stroke to allow an erected and closed box to be expelled from the forming slot. In this second embodiment the closing fork has two arms arranged substantially at right angles, namely a first arm which runs parallel to the axis of the forming slot and a second arm of which the upper planar part runs at right angles to the axis of the forming slot, whilst the lower part has a concave profile. The plane upper part of the second arm of the fork is intended substantially to abut against the two folding-over blades in the close position at the instant of closing a box inside the forming slot, whilst its lower part is intended to allow pivoting in the clockwise direction, on the one hand of the end panel of the erected box about its folding line which connects it to the upper panel of the box and, on the other hand of the tab about its folding line which connects it to the said end panel.

The first arm of the closing fork is in the form of a thin blade which is intended to enter the interior of the box through the slit formed between the two folded-over end tabs and the lower panel of the box, at the instant of the operation of closing the said box.

DESCRIPTION OF THE PREFERRED EMBODIMENT

In order that the present invention may more readily be understood there will now be described, by way of purely illustrative examples and without implying any limitation, two embodiments shown in the attached drawing.

Figure 1:
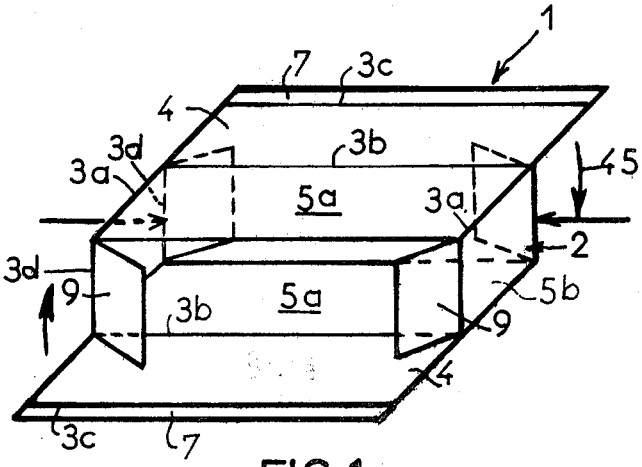
FIG. 1 shows in perspective a box made of cardboard or some other similar semi-rigid material, after the forming operation on a machine, according to the invention, but before the subsequent operation of closing one of its ends.

Referring to FIG. 1 of the drawing, there will be seen a box 1 made of cardboard or of some other suitable semi-rigid material. For reasons of bulk, the box is supplied in the form of a flat blank having pre-determined and scored folding edges which make it possible to erect and close the box without requiring a glueing operation. The blank 1 shown in FIG. 1 has undergone a first forming operation in which the case 2 of the box has been converted from a substantially planar configuration to that of a rectangular parallelepiped. The case 2 consists of four panels transversely delimited by folding lines 3*a* which are parallel to that axis of the symmetry of the case which passes through the two open ends of the case. As is conventional, the case 2 of the box can be closed at each of its ends by the same closing system, which comprises a transverse end panel 4 which is connected to the upper panel 5*a* of the case 2 by a folding line 3*b* which runs at right angles to the axis of the case. The end panel 4 is continued in a tab 7 which is hinged along a folding line 3*c* parallel to the folding line 3*b*. Two flaps 9 are hinged along two transverse folding lines 3*d* to the two lateral panels 5*b* of the case 2. Closing one of the ends of the case 2 can be separated into two successive operations, namely, first of all, an operation wherein the two flaps 9 are folded towards the interior of the case 2, so as to arrange them in one and the same plane at right angles to the above-mentioned axis of the case, and a second operation during which the end panel 4 is pivoted about the folding line 3*b* towards the interior of the case 2 and the tab 7 is engaged in the slit defined between the lower panel 5*a* of the case and the two coplanar flaps 9 located at right angles to the axis of the case.

Figure 2:
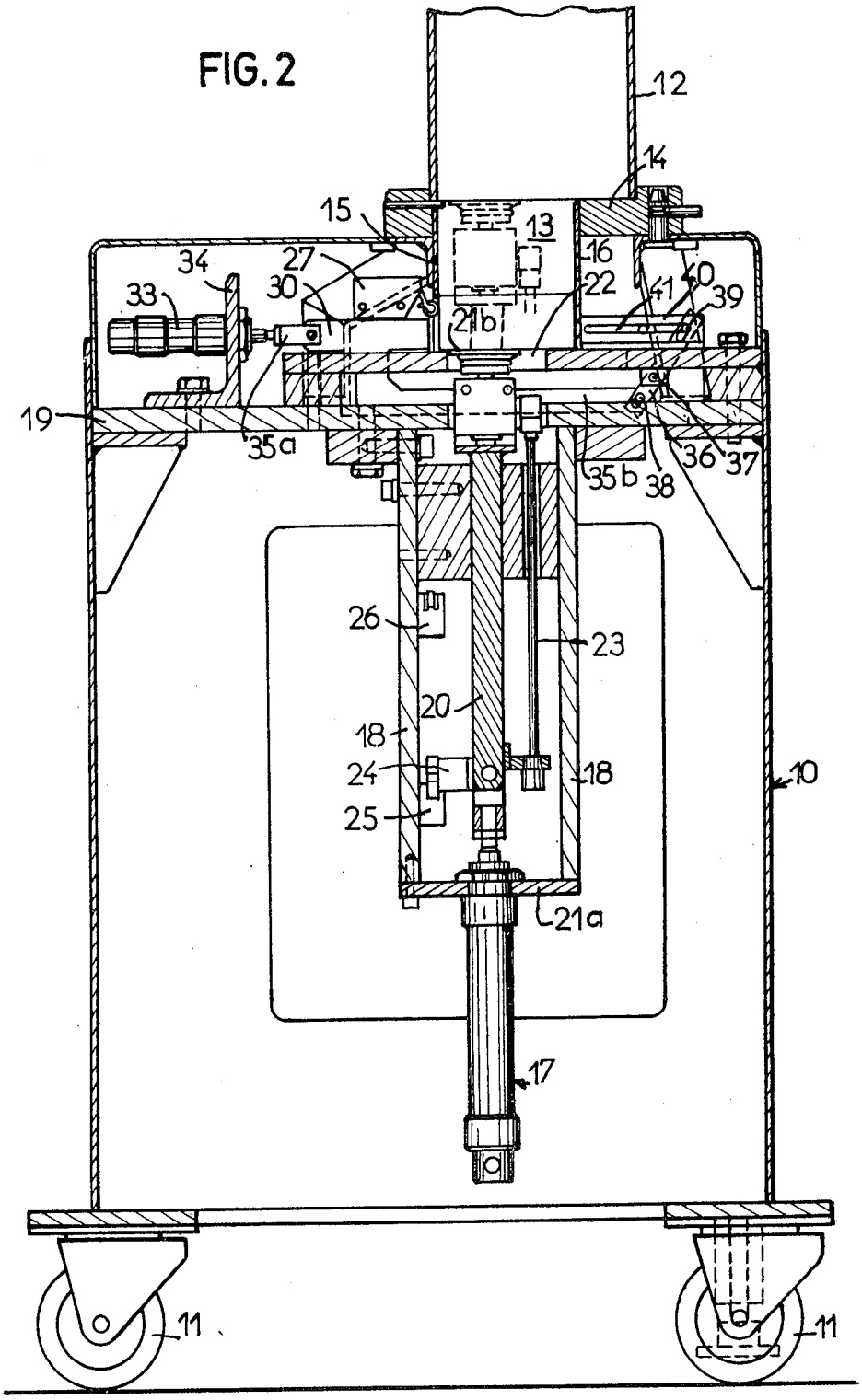
FIG. 2 is a transverse vertical section of the device according to the invention, the plane of section being on the line II—II of FIG. 4.
Figure 3:
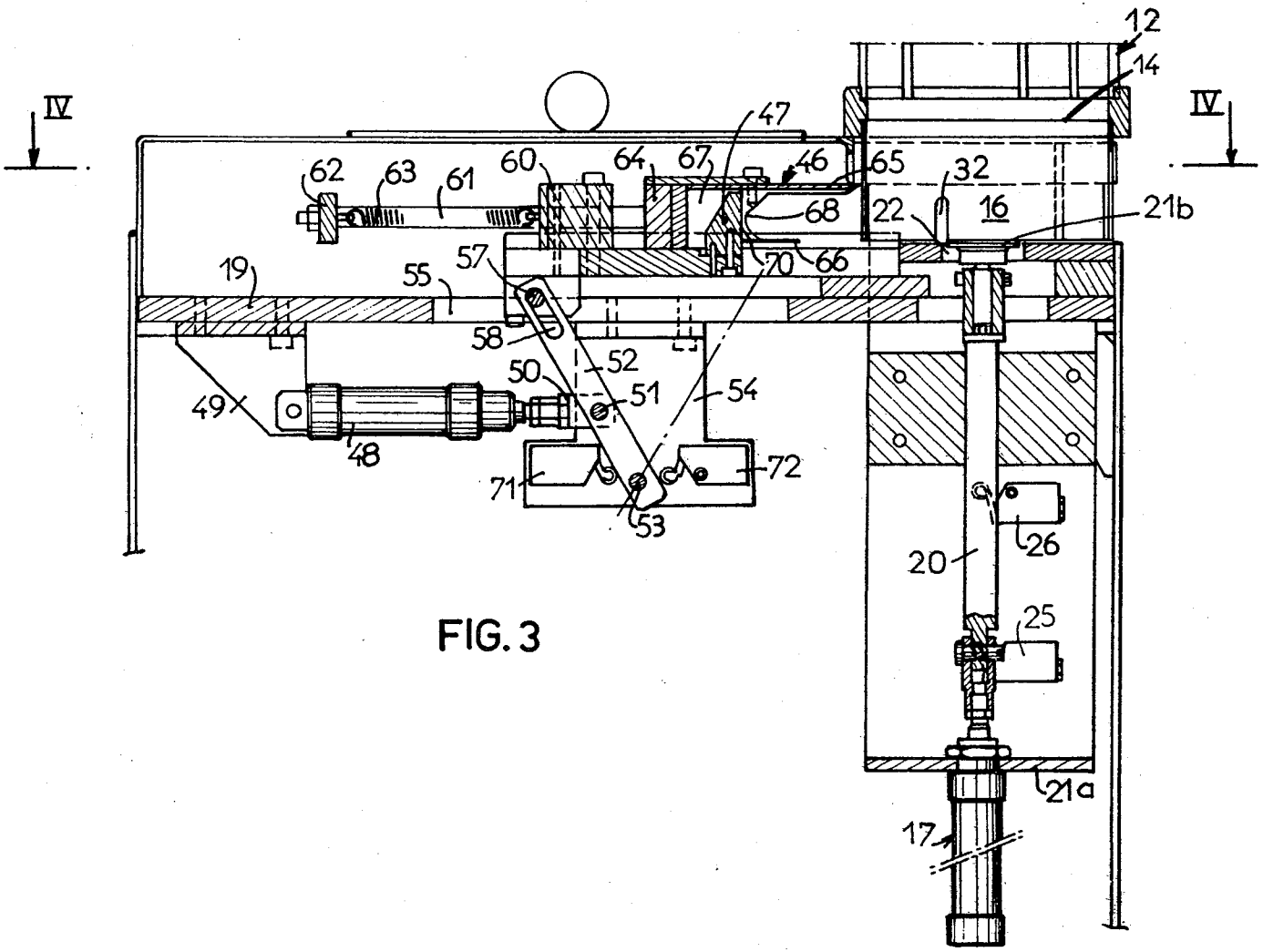
FIG. 3 is a longitudinal vertical section along line III—III of FIG. 4.
Figure 4:
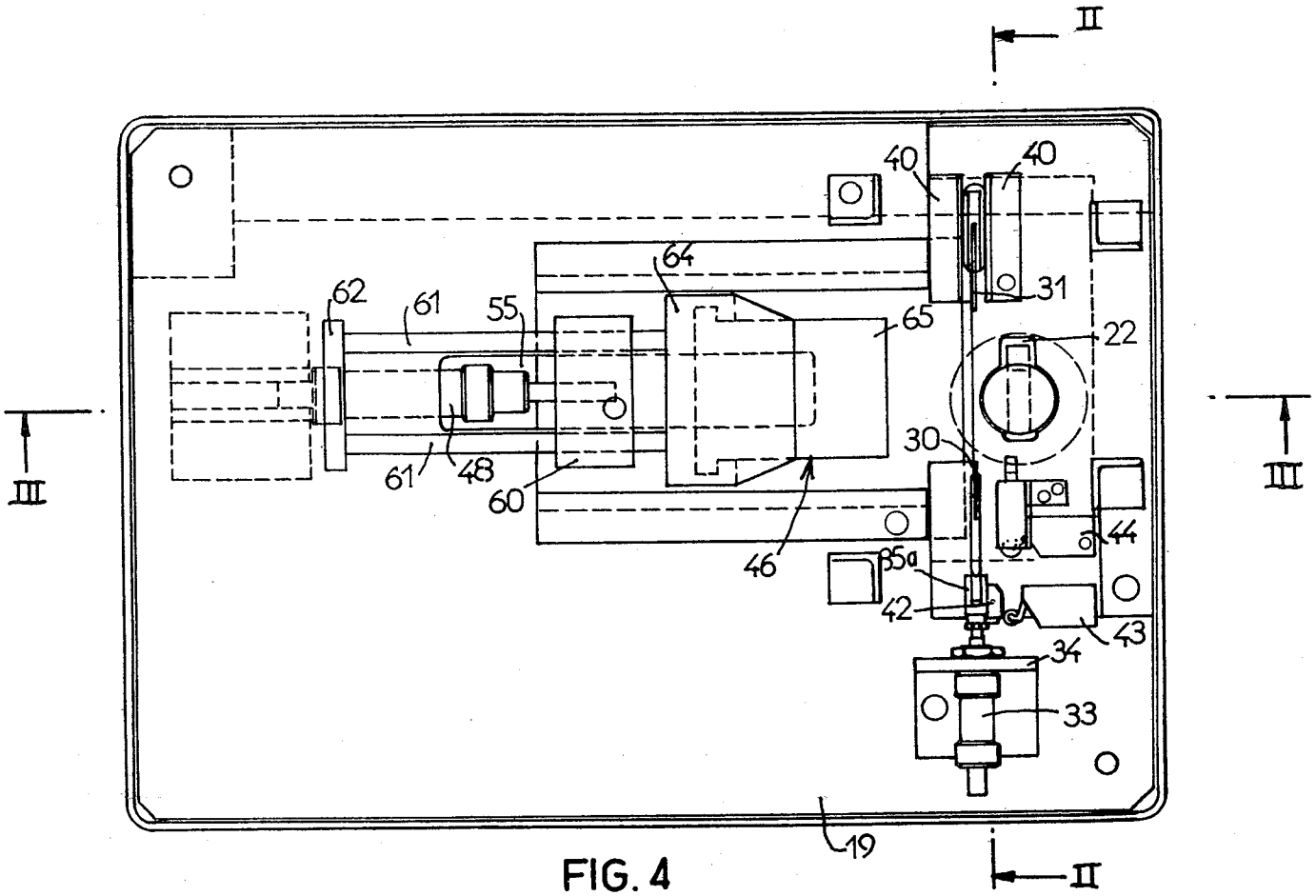
FIG. 4 is a top view of the device according to the invention, taken along line IV—IV of FIG. 3, the feeder and the forming slot being omitted for purposes of clarity.

The device shown in FIGS. 2 to 4 is intended to carry out without any manual intervention, two successive operations on a cardboard box 1 arranged in the flat form, namely:

(a) an operation of erecting the case 2 of the box so as to impart to it the rectangular parallelepiped shape shown in FIG. 1; and (b) an operation of closing one of the ends of the box 1, which operation itself can be broken down into two successive stages, namely a first stage consisting of folding over the two flaps 9 followed by the second stage of positioning the end panel 4 and engaging its tab 7 inside the case.

The device according to the invention comprises a sheet-metal framework 10 mounted on running gear, in this case wheels 11. A feed guide 12 of rectangular cross-section is intended to contain a stack of box blanks 1 arranged in the flat form. The cross-section of the feed guide 12 has the shape of one blank 1 arranged in the flat form. In other words, the length of the feed guide 12 is substantially the same as the length of the case 2 of the box plus twice the length of an end panel 4 and its tab 7; the width of the feed guide 12 is that of a box blank 1 arranged in the flat form, that is to say equal to the length of a panel 5*a* plus the height of a side panel 5*b*. The box blanks 1 stacked flat inside the feed guide 12 are so arranged that their ends which are intended to be closed are all located on the same side. The feed guide 12 is supplied from above with box blanks 1.

At its lower part, the feed guide 12 connects to a U-shaped forming slot 13, which is open at both its ends; such a slot has two parallel guide arms 15 and 16 which are connected at right angles to the bottom of the said slot (FIG. 2). The width of the slot 13 (from right to left in FIG. 2) is substantially equal to the length common to the lower and upper panels 5*a* of the boxes 1 whilst the width of the feed guide 12 is substantially equal to the length common to the lower and upper panels 5*a* plus the width of a lateral panel 5*b*; the length of the slot 13 (into the paper) is substantially equal to that of the feed guide 12. The reduction in width of the forming slot 13, relative to the length of the feed guide 12 which is vertically above it, is due to a shoulder 14 which extends along one of the sides of the feeder 12. The width of the shoulder 14 is substantially equal to the width of a lateral panel 5*b*, so that the folding line 3*a* located between the lower panel 5*a* and the lateral panel 5*b* of the case is substantially located along the edge of intersection of the shoulder 14 with the guide arm 16 of the forming slot 13. Hence, if the lower panel 5*a* of a box blank 1, arranged in the flat form in the feed guide 12, is pulled downwards so as to introduce this panel 5*a* of the box into the forming slot 13, this introduction operation has the effect of erecting the lateral panel 5*b*, which in the flat blank was located on the shoulder 14, as well as erecting the opposite lateral panel 5*b* via the upper panel 5*a* of the case. By virtue of the guiding provided by the vertical arms 15 and 16 of the slot the lateral panels 5*b* assume a position at right angles to the lower and upper panels 5*a* of the case if the operation of introducing the box 1 in question into the slot 13 is continued.

In the device according to the invention, the member for introducing the box blanks 1 from the feed guide 12 into the forming slot 13 is a double-action jack 17 which is combined with suction means which allow the lower panel or base 5*a* of the box to be fixed to the head of the jack 17. The body of the double-action jack is fixed (FIG. 2) to a yoke 21*a* which is itself fixed by two arms 18 to a support plate 19. The support plate 19 runs parallel to the plane of travel of the framework 10; the jack 17 is located within the framework 10, between the support plate 19 and the running gear 11. The piston rod of the jack is fastened to a slide 20 which can move between the two arms 18 which support the yoke 21*a* to which the body of the jack is fixed. The slide bar 20 terminates in a head 21*b* which can enter the forming slot 13 between the two guide arms 15 and 16 by virtue of an orifice 22 provided in the bottom of the said slot. The slide bar 20 can slide along an axis at right angles to the plane of travel of the device, that is to say in a vertical plane if the plane of travel is horizontal. The axis of the slide bar 20 and of the jack piston rod runs parallel to the two guide arms 15, 16 of the forming slot 13 and is located between them. In other words, the axis of the jack piston rod and of the slide bar 20 is substantially at right angles to the axis of the case of a box blank 1 which is contained in the forming slot 13. A suction tube 23 is attached along the slide bar 20 and communicates with the suction means 21*b* of the jack so as to create a partial vacuum at the suction means, this partial vacuum being necessary to fix the suction means 21*b* to the lower panel 5*a* of a box 1. The length of the stroke of the slide bar 20 is regulated so that the suction means 21*b* can travel substantially the full height of the forming slot 13 and can occupy two end positions, on the one hand a retracted position (shown in solid lines in the drawing) where the upper plane wall of the suction means 21*b* constitutes the extension of the bottom of the forming slot 13 and, on the other hand an extended position (shown in broken lines in FIG. 2) where the suction means 21*b* constitutes the extension of the shoulder 14. A finger 24 carried by the slide bar 20 can actuate two limit switches firmly fixed to the framework, namely a lower switch 25 which is actuated when the slide bar 20 is in the retracted position and a switch 26 which is actuated when the slide bar is in the extended position.

Inside the forming slot 13 there projects the roller of a switch 27 (FIG. 2), which is used to control an automatic cycle in which a box 1 is erected and folded. When the operator removes from slot 13 a box which has undergone the two operations of forming and closing one end, the roller of the switch 27 which has until then been depressed is released and this has the effect of triggering a new cycle; that is to say, as will be explained in detail later, the triggering of the raising of the slide bar 20, the starting of the suction at the instant at which the slide bar 20 reaches its extended position, and thereafter the return of the slide bar 20 to its retracted position. The partial vacuum created at the suction means 21*b* of the jack allows the head to be fixed to the lower panel 5*a* of a box 1 contained in the feed guide 12, so that the return of the slide bar 20 to its retracted position makes it possible to introduce the box in question into the forming slot 13 and hence to erect the box. The suction, that is to say the fixing of the lower panel 5*a* to the suction means 21 of the jack, is continued during the subsequent stage of closing one of the ends of the box 1 which has been erected inside the slot 13.

When the piston rod of the jack 17, and the slide bar 20 are returned to their retracted positions, this triggers the operation of closing the box 1 erected in the slot 13, more precisely the first stage of the operation of closing, namely the stage of folding over the two end flaps 9 towards the interior of the case of the box, to arrange them so that one substantially forms the extension of the other. This first folding-over stage is effected by means of two blades 30 and 31 (see FIGS. 2 and 4) which are co-planar, are translationally guided and can be simultaneously brought together or moved apart from one another by movement through respective windows (not shown) in the guide arms 15, 16 of the forming slot. The plane in which the two blades 30 and 31 slide is at right angles to the axis of the case of the box and substantially coincides with the plane of closing of the erected box 1, which plane contains the folding edges 3*d* of the two end flaps 9. In the maximum separation position (shown in the drawing) the two blades 30 and 31 are located on either side of the forming slot 13. If the two folding-over blades 30 and 31 are brought close to one another, they can enter the forming slot 13 by virtue of windows formed in the two guide arms 15 and 16 of the slot. FIG. 3 of the drawing shows that the folding-over blade 31 enters the forming slot 13 via the window 32 formed in the lower part of the guide arm 16.

The alternating translational movement which can be communicated to the two folding-over blades 30 and 31 is achieved by means of a further double-action jack 33. The fixed cylinder of the jack 33 is carried by a bracket 34 fixed to the support plate 19. The end of the movable piston rod of the jack 33 terminates in a clevis 35*a* which provides a direct connection between the piston rod of the jack 33 and the carrier of the blade 30. The blade 30 is mechanically connected to a transmission arm 35*b* (FIG. 2) used to impart to the opposite blade 31 an alternating rectilinear movement. The arm 35*b*, like the blade 30 firmly fixed thereto, can be subjected to an alternating translational movement by means of the same double-action jack 33. The alternating translational movement is transmitted to the blade 31 by means of the arm 35*b* via a small oscillating connecting rod 36 mounted to pivot about a fixed axis 37. As the arm 35*b* executes a rectilinear movement and the oscillating connecting rod 36 is mounted to rotate about its axis 37, the connection between the arm 35*b* and one of the ends of the oscillating connecting rod 36, namely the end which does not act on the blade 31, is provided by means of an articulation pin 38 which can move in an oblong hole, the length of which corresponds to the length of the stroke of the arm 35*b*. Conversely, the opposite pivoting end of the oscillating connecting rod 36 is used to impart an alternating rectilinear movement to the blade 31. Hence, the articulation between the blade 31 and the end in question of the connecting rod 36 consists of another articulation pin 39 firmly fixed to the blade 31 and located inside another oblong hole formed at the associated end of the oscillating connecting rod 36. The blade 31, as well as its holder, are mounted so as to slide between the two parallel arms of two brackets 40 (FIG. 4) which are firmly fixed to the framework. Each of the parallel arms of the brackets 40 has a rectilinear groove 41 which runs parallel to the axis of the sliding movement of the blade 31, the length of this groove being substantially equal to the stroke of the said blade. The axle 39, which projects on either side of the holder of the blade 31, can move in the two rectilinear grooves 41. Thus, the articulation pin 39 not only participates in the articulation between the oscillating connecting rod 36 and the blade 31, but also participates in translationally guiding the blade 31 between the parallel arms of the two brackets 40.

The clevis 35*a* between the piston rod of the jack 33 and the blade 30 is firmly fixed to a finger 42 (see FIG. 4) which actuates two limit switches, namely a switch 43 which is operated when the two co-planar blades 30 and 31 are in the position of maximum separation as shown in the drawing, and a switch 44 which is operated when the two co-planar blades 30 and 31 are in the closest-together position.

When the two folding-over blades 30 and 31 have been brought together for the purpose of folding over the two end flaps 9 so as to locate them in a plane at right angles to the axis of the case, these two blades 30 and 31 are kept in the close position whilst the actual closing stage takes place. This closing stage itself can be broken down into two successive operations, of which the first consists in causing the end panel 4 to pivot about its folding line 3*b* in the clockwise direction as indicated by the arrow 45 in FIG. 1; this operation is accompanied by a rotation of the tab 7 about its folding line 3*c*, which connects the tab to the end panel 4, so as to move the tab 7 from a position where it is substantially the extension of the end panel 4 (as shown in FIG. 1) to a position where it forms, with the panel 4, a dihedral angle smaller than a right angle. In this latter position, the tab 7 is located opposite the introduction slit formed between the lower panel 5*a* of the case of the box and the two co-planar flaps 9 held in position by the two folding-over blades 30 and 31.

The final closing operation of course consists in introducing the tab 7 into the slit referred to above and in bringing the end panel 4 to rest against the edge of the case of the box, that is to say into a plane at right angles to the axis of the case. The first operation, of folding the end panel 4 and its tab, is effected by means of a closing fork 46 whilst the final stage of introducing the tab 7 into the case of the box is effected by means of a pushing member 47 (FIG. 3). The closing fork 46 and the pushing member 47 can be simultaneously subjected to an alternating rectilinear movement by virtue of the action of a jack 48. The jack 48 is hinged to a bracket 49 fixed to the plate 19 which in turn is firmly fixed to the framework. An oscillating small connecting rod 52 is hinged at 51 to the end of the piston rod of the jack 48 between the two arms of a strap 50. The connecting rod 52 is mounted to rotate about a pivot spindle 53 which is carried at its two ends by two arms 54 firmly fixed to the support plate 19. The oscillating connecting rod 52 can pivot about its spindle 53 between the two arms 54 which support the spindle. A rectilinear guide groove 55 is formed in the plate 19 between the two arms 54 which carry the axle of the oscillating connecting rod 52. The longitudinal median plane of the groove 55 is substantially located in the extension of the plane of symmetry of the two guide arms 15 and 16 of the forming slot 13. A slide 56, on which are mounted both the pusher member 47 and the closing fork 46, can slide in the rectilinear groove 55. The alternating rectilinear movement which can be imparted to the slide 56 is transmitted by the opposite end to the spindle 53 of the oscillating connecting rod 52. A pin 57 carried between the two arms of a clevis firmly fixed to the slide 56 is located in an oblong hole 58 formed in the end of the oscillating connecting rod 52 opposite the spindle 53. By virtue of a hinge system of this type, the oscillating connecting rod 52 can, by pivoting about its spindle 53, cause the slide 56 to undergo an alternating rectilinear movement. The axis of the sliding movement of the slide 56 is at right angles to the plane in which the folding-over blades 30 and 31 slide, and substantially coincides with the axial median plane of the forming slot 13. The slide 56 is located at right angles to one of the end orifices of the slot 13, at the other end from that where a completed box 1, that is to say a box which has been erected and closed at one of its ends, is removed manually. The pusher member 47 is fixed to the end of the slide 56 which is located facing the forming slot 13.

A projecting support 60 is provided on the slide 56, near its end opposite to that which carries the pusher member 47. Inside the support 60 are slidably supported two tubular guides 61, parallel to and separated from one another. The guides 61 are arranged parallel to the guide arms 15 and 16 of the forming slot 13. A yoke 62 connects the ends of the guides 61. The yoke 62 is located on the side of the support 60 away from the forming slot 13. A spring 63 connects the yoke 62 to the support 60. The two ends of the guides 61 which are not connected to the yoke 62 are firmly fixed to a fork holder 64; the latter is located on the slide 56 between the pusher member 47 and the support 60 and can move between these two members against the action of the spring 63.

The closing fork 46, which is removably mounted in the fork carrier 64, has two parallel arms 65 and 66 which run at right angles to the plane of the guide arms 15, 16 of the forming slot 13. The distance which separates the two parallel arms 65, 66 of the fork 46 is substantially equal to the height of a box 1 located inside the forming slot 13. When the jack 48 is in the extended position, the upper arm 65 of the fork is intended substantially to rest against the upper panel 5*a* of a box which is to be closed and which is contained in the forming slot 13, whilst the lower arm 66, which is thin, is intended to enter the slit between the two folded-over flaps 9 and the lower panel 5*a* of the box. The length of the lower arm 66 of the closing fork 46 is less than that of the upper arm 65, the latter being intended to extend over the entire length of the case of the box to be closed when the jack 48 is in the extended position, that is to say in the position where the fork 46 enters the forming slot 13 in order to carry out the operation of closing the end panel 4 onto the case of the box. Inside the closing fork 46, perpendicularly between the two arms 65 and 66, are parallel fins 67 spaced out at regular intervals. The edge of each fin 67 which faces the forming slot 13 has a concave profile 68. During the operation of advancing the fork 46 towards the interior of the slot 13 this concave profile serves gradually to fold the tab 7 downwardly relative to the initially horizontal end panel 4, about the folding line 3*c*, so as to bring it from its initial position where it was substantially the extension of the end panel 4 to a position where it forms an acute dihedral angle relative to the end panel 4 and is located facing the slit for introduction into the box. The fork 46 is intended to come to a stop when the concave profile 68 of the fins 67 is against the two folding-over blades 30 and 31 projecting into the forming slot. The fins 67 are continued, parallel to the upper arm 65 of the closing fork 46, by co-planar strips which constitute the lower arm 66 of the fork.

The pusher member 47 is in the form of a plurality of parallel teeth mechanically connected to the slide 56, between which teeth are located the profiled fins 67 firmly fixed to the fork 46. The pusher member 47 presents, facing the forming slot 13, a contact surface 70 which is substantially planar and runs at right angles to the two guide arms 15, 16 of the forming slot 13. In the rest position, that is to say in the position shown in FIGS. 3 and 4, where the piston rod of the jack 48 is in the retracted position, the contact surface 70 defined by the teeth which constitute the pusher member 47 is slightly retracted relative to the concave profile 68 of the fins 67.

As can be seen in FIG. 3 of the drawing, the oscillating connecting rod 52 comes into contact with the roller of a limit switch 71 when the jack 48 is in the retracted position and the connecting rod 52 actuates another limit switch 72 when the jack 48 is in the extended position. The switch 72 is used to trigger the return, into the initial position, of the two blades 30 and 31 for folding-over the two end flaps of the boxes to be closed.

The operation of closing an end panel 4 onto the orifice of a box placed in the forming slot, and of introducing its tab 7 into the said box, takes place as follows. With the two folding-over blades 30 and 31 in their close position and projecting into the forming slot 13, the jack 48 is actuated with the result that the oscillating connecting rod 52 is moved from the position shown in FIG. 3 to the position schematically indicated by the chain dotted line in the same FIG. 3. In the course of pivoting about the spindle 53, the oscillating connecting rod 52 moves the slide 56 in the direction towards the forming slot. The end panel 4 and its tab 7 are entrained between the two arms 65 and 66 of the fork 46 which enters the forming slot. Under the action of the upper arm 65 and the concave profile 68 of the fins 67, the end panel 4 of the box pivots about the folding line 3*c* which connects it to the upper panel 5*a* of the case of the box, whilst at the same time the tab 7 is folded in the direction of the inner face of the associated end panel 4. During the advance of the slide 56 the upper arm 65 of the fork moves above the upper panel 5*a* of the case of the box whilst the lower arm 66 enters the slit formed between the two folded-over flaps 9 and the lower panel 5*a* of the case of the box. The translational movement of the closing fork 46 is continued until the concave profile 68 of the fins 67 makes contact with the two folding-over blades 30 and 31 of the end tabs; the fork 46 is thus blocked in respect of translational movement, but the slide 56 and the pusher member 47, which are firmly fixed thereto, can continue to advance against the action of the spring 63; the pusher member 47 can thus move relative to the closing fork 46 and makes it possible to complete the closing of the box, that is to say the introduction of the tab 7 into the case and the bringing of the end panel 4 into contact with the edge of the case so that this end panel 4 is located substantially in a plane at right angles to the axis of the case. The stroke of the pusher member 47, and hence that of the slide 56 relative to the closing fork 46, is approximately equal to the radius of curvature of the concave profile 68 of the fins 67.

As has been seen, the operation of advancing the pusher member 47 and the slide 56 is interrupted when the contact surface 70 of the teeth which constitute the pusher member 47 substantially comes to rest against the two blades 30 and 31 for folding over the end flaps 9. In this position, the limit switch 72 is actuated. The jack 48 can thus return to the retracted position at the same time as the pusher member 47, under the action of the spring 63, resumes its original position (shown in FIG. 3) relative to the closing fork 46. The actuation of the switch 72 has caused the blades 30 and 31 to return to the maximum separation position, so that the closed box located inside the forming slot 13 can be removed manually through that orifice of the said slot 13 which is remote from the fork 46. The removal of the closed box from the slot actuates the switch 27 (FIG. 2) and hence triggers a new cycle of forming and closing the next box blank 1 located in the flat state inside the feeder 12.

Figure 5:
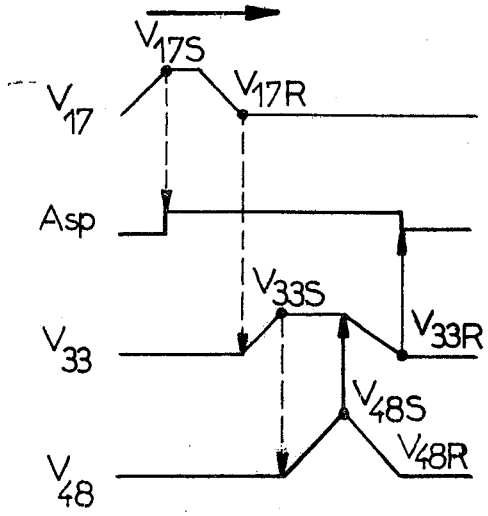
FIG. 5 illustrates the sequence of actuation of the members for introducing a box into the forming slot and also of the members for closing the said box.

FIG. 5 shows the sequence of control operations of the blank feeding jack 17, of the application of suction, of the folding-over jack 33, and of the closing jack 48, during a complete cycle of forming and closing a box carried out by the device according to the invention.

The control of the blank feed jack 17 is triggered when the forming slot 13 is again empty, this condition being detected by the switch 27 (FIG. 2). The jack 17 reaches its extended position $V_{17S}$ at which time it is possible to start the suction, and to hold, by a partial vacuum, a lower panel 5*a* of the next box blank onto the suction means 21*b* of the jack 17.

The jack 17 is kept in the extended position for a short period of time and then resumes its original position $V_{17R}$. The return of the jack 17 into the retracted position $V_{17R}$ triggers the control of the jack 33 and actuates the folding-over blades 30 and 31 of the end flaps 9 of the box which is to be closed.

When, in its turn, the folding-over jack 33 reaches the protruded position $V_{33S}$, the closing jack 48, which acts on the fork 46 and on the pusher member 47, is actuated. The closing jack 48 reaches its extended position $V_{48S}$ and immediately returns to its initial position $V_{48R}$.

The return of the folding-over jack 33 into the retracted position $V_{33R}$ is triggered at the instant at which the closing jack 48 reaches its extended position $V_{48S}$. When the folding-over jack 33 reaches the returned position $V_{33R}$, it has the effect of stopping the suction. The cycle of forming and closing a box takes about 6 seconds in the case of small boxes.

Figure 6:
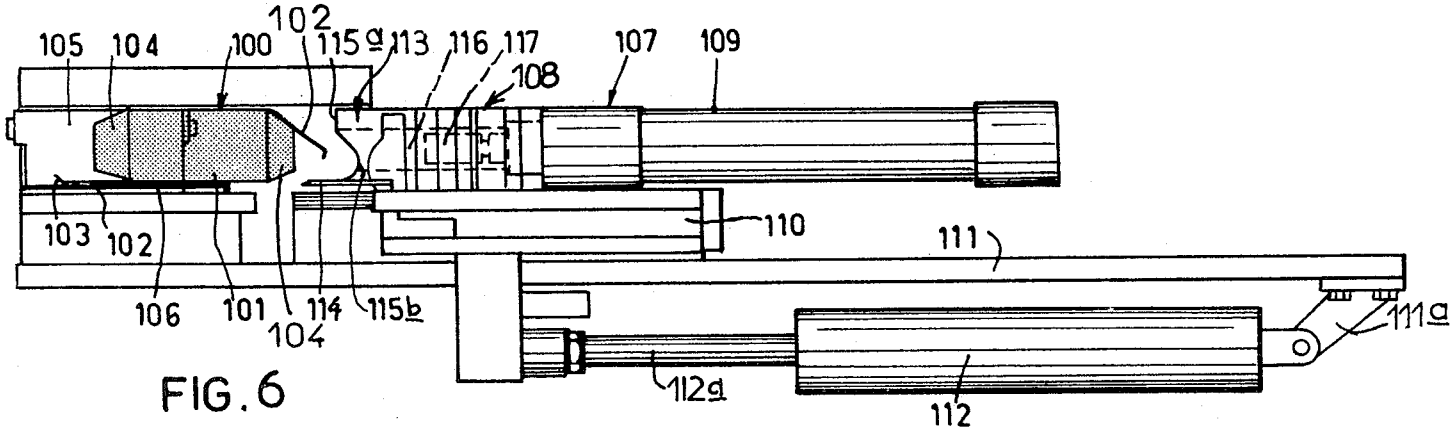
FIG. 6 shows schematically a longitudinal vertical section, parallel to the axis of the forming slot, of a device for closing and removing a box, this device being intended to be fitted to the machine of FIGS. 1 to 5.
Figure 7:
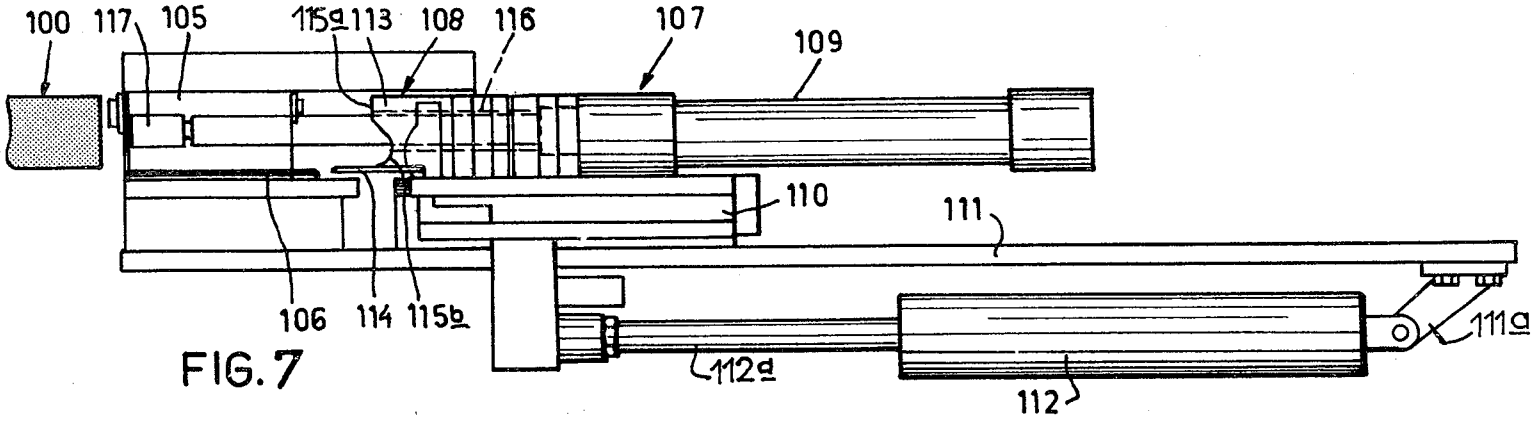
FIG. 7 represents a view similar to that of FIG. 6, but with the closing device shown in the working position after closing and removing a box from the forming slot.

FIGS. 6 and 7 show a different embodiment of the closing members with which the machine of FIGS. 1 to 4 may be equipped. In this embodiment, the closing members consist of a closing fork which is alone able completely to close a box erected inside the forming slot 13. This closing fork is associated with a removal jack which allows the erected and closed boxes to be ejected from the forming slot.

In this embodiment, the box blanks are located in the flat state inside a feed guide (not shown) which is located vertically above a forming slot inside which the boxes are erected. The forming slot has two parallel side arms 105 connected to a bottom 106. The distance between the two side arms 105 of the forming slot is substantially equal to the width of the upper and lower panels of the case 101 of the box. The forming slot is open at its two ends. One of these ends is located facing the device, generally designated 107, for closing the boxes and removing the completed boxes. The erected and closed boxes are removed through the opposite end orifice of the forming slot.

When a box has been introduced and erected inside the forming slot, by employing the mechanical means previously described in connection with FIGS. 1 to 5, the end of the case located facing the closing and removal device 107 must be closed. The box blanks are positioned in the feed guide in such a way that after they have been shaped inside the forming slot the end panel 102 which is present on the side of the box which is to be closed is located at the top of the box. Thus the end panel 102 can under the effect of its own weight assume an inclined position which facilitates its positioning on the open end of the case of the box.

The closing of one of the ends of the case 101 of a box located inside the forming slot can be broken down into two successive operations. First of all, an operation of folding the two flaps 104 towards the interior of the case 101 is effected, so as to locate them in one and the same plane at right angles to the axis of the case; thereafter an operation ensues in which the end panel 104 is pivoted in the clockwise direction on the drawing and in which the flap 103 is engaged in the slit defined between the lower panel of the case and the two co-planar flaps 104 loacted at right angles to the axis of the case. The operation of folding over the two flaps 104 is carried out, as described previously, by means of two folding-over blades (not shown) which are located on either side of the forming slot and which blades can assume two positions, namely a separated position in which they do not project into the forming slot, and a close position where they do project into the forming slot so as to bring the two end flaps 104 into a plane at right angles to the axis of the case. The two foling-over blades are kept in the close position during the subsequent operation of closing the box by means of the closing and removal device 107.

The device 107 comprises on the one hand a closing fork 108, and on the other hand an ejector jack 109. A slide 110, on which the closing fork 108 and the ejector jack 109 are mounted, can execute an alternating rectilinear movement. The sliding axis of the slide 110 is at right angles to the plane of movement of the blades for folding over the two flaps 104, and substantially coincides with the axis of the forming slot. The slide 110 is slidably mounted on a plate 111 firmly fixed to the framework of the box-forming machine. The alternating rectilinear movement to be imparted to the slide 110 is effected by means of a control jack 112. The cylinder of the jack 112 is hinged to a bracket 111*a* fixed under the plate 111 which carries the slide 110. The movable piston rod 112*a* of the control jack 112 is firmly fixed to the slide 110. As can be seen in FIGS. 6 and 7, the slide 110 can assume two positions namely (a) a position remote from the forming slot and (b) a position close to the forming slot, in which the closing fork 108 substantially comes up against the blades for folding over the end flaps 104.

Relative to the forming slot, the closing fork 108 is located at the front of the slide 110 whilst the removal jack 109 is carried at the rear of the said slide.

The closing fork 108 comprises two arms 113 and 114 arranged substantially at a right angle. The height of the arm 113 of the fork 108 is substantially equal to that of a box erected within the forming slot; the arm 113 of the fork 108 has a plane upper part 115*a* and a part 115*b* in the shape of a convex curve. The upper part 115*a* of the arm 113 runs at right angles to the axis of the forming slot; it is intended substantially to come up against the blades for folding over the two endflaps 104 when the slide 110 is in the close position shown in FIG. 6. The lower part 115*b* of the arm 113 having the concave profile thus serves, during the operation of advancing the slide in the direction of the forming slot, firstly to cause the end panel 102 to pivot in a clockwise direction and secondly to fold the flap 103 gradually about its folding line which connects it to the end panel 102. A gradual folding of the flap 103 makes it possible to bring the flap from an initial position where it is substantially the extension of the end panel 102 to a position where it substantially forms a right angle relative to the latter and where it is located inside the erected box 100.

The arm 114 of the closing fork 108 runs parallel to the bottom of the forming slot; it is in the form of a thin blade which is intended to enter the slit which exists between the two substantially co-planar folded-over flaps 104 and the lower panel of an erected box, in order to guide the flap 103 into the said slit.

The closing fork 108 is provided with a passage 116 in which the piston rod 117 of the ejector jack 109 can move. As can be seen in the drawing, the ejector jack can assume two positions, namely a retracted position (FIG. 6) in which the piston rod 117 does not project relative to the closing fork 108, and an extended position (FIG. 7) in which the piston rod 117 substantially reaches the end of the forming slot from which the completed boxes are removed when the slide 110 is in the close position.

The closing and removal device which has just been described functions as follows: a box 100, which has come from the feed guide (not shown), has been erected inside the forming slot, and the two folding-over blades (not shown) have then been brought into the close position projecting into the forming slot so as to bring the two end flaps 104 into one and the same plane at right angles to the axis of the case of the box which is to be closed. Whilst the two folding-over blades are kept in the close position, the control jack 112 is actuated and moves the slide 110 in the direction towards the forming slot.

The end panel 102, which under the action of its own weight has assumed an inclined position, comes into contact with the concave profile of the lower part 115*b* of the arm 113 of the fork, which enters the forming slot. Under the action of this concave profile the end panel 102 of the erected box pivots about its folding line which connects it to the upper panel of the box, whilst at the same time the flap 103 pivots about its folding line which connects it to the end panel 102, until it forms a dihedral angle of about 90° relative to the said panel. The horizontal arm 114 of the closing fork 108 enters the erected box and when the vertical arm 113 of the fork comes into contact with the end panel 102, this end panel which is only at a small dihedral angle relative to the closing plane of the box is pushed against the said closing plane and the tab, guided by the horizontal arm 114 of the fork, is introduced into the box. When the arm 113 of the closing fork 108 comes into contact, via its planar upper part 115*a*, with the two folding-over blades in their close position, the closing operation is complete. The flap 103 is located inside the case 101 of the box and the end panel 102 is located at right angles to the axis of the said case. At that instant, the two folding-over blades are withdrawn from the forming slot and the ejector jack 109 is actuated whilst the slide 110 retains its close position. The rod 117 of the ejector jack 109 passes through the closing fork 108 and then abuts against the end of the box which has just been closed, and pushes the said box out of the forming slot, as illustrated in FIG. 7.

Of course the embodiments described above do not imply any limitation and can be modified in any desirable manner without thereby departing from the scope of the present invention.

We claim:

1. A device for forming folding boxes from flat box blanks made of cardboard or of a similar semi-rigid material and then to close one of their ends, said formed boxes defining a case having four folding edges which run parallel to the axis of the case and which define four panels, namely a first pair consisting of a lower panel and an opposite upper panel and a second pair consisting of two lateral panels, at least that end of the case which it is desired to close having on the one hand an end panel connected by a folding line to one of said upper and lower panels of the case, and on the other hand two transverse flaps which are each connected by a folding line to a respective said lateral panel of the case, the said end panel being extended by a tab intended to be introduced into the case of the formed box, said device comprising:

(a) feed means adapted to receive the flat box blanks stacked on top of one another with the ends of the boxes which it is desired to close all being arranged on the same side of said feed means;

(b) means defining a forming slot of U-shaped cross-section having a top and a bottom and an axis extending between first and second open ends, said first end being designed to pass a completed box after the forming and closing cycle;

(c) means effective to fold over said two end flaps of the formed box towards one another inside the forming slot, and to arrange them substantially in one and the same plane;

(d) closing means to pivot the end panel and engage its associated tab with the interior of the case of the box; and (e) means operable to move said closing means translationally parallel to the axis of said forming slot, said closing means being arranged opposite said second opening.

2. A device according to claim 1, wherein the flat box blanks are stacked inside the feed means such that the said end panel to be positioned is connected to the said upper panel of the box cases.

3. A device according to claim 1, including means defining an orifice in the bottom of the forming slot; a double-action blank feed jack; means carried by said double-action jack to hold a box blank to be formed into a box; means guiding said holding means into the forming slot; and means operating said double-action jack to move said box blank holding means in an alternating translational movement between two extreme positions namely a retracted position where it is substantially flush with the bottom of said forming slot and an extended position where it is substantially flush with the top of the forming slot.

4. A device according to claim 3, wherein said box blank holding means comprise suction means to hold the lower panel of a box blank in the feed means by a partial vacuum.

5. A device according to claim 4, and including means for applying suction to said suction means when said box blank feed jack reaches its extended position and for maintaining suction at least until said box blank feed jack reaches its retracted position.

6. A device according to any one of claims 1 to 5, wherein said means for folding over the two end flaps comprise two substantially co-planar blades and means for moving said blades together or moving them apart, wherein the plane of movement of said blades runs at right angles to the side walls of the forming slot, and these two folding-over blades are able to assume two extreme positions relative to one another at opposite ends of a stroke, namely a separated position in which the two blades are located on either side of said forming slot, and a close position in which said two blades protrude into said forming slot through two windows in the said slot.

7. A device according to claim 6, wherein said means for moving said two folding-over blades comprises a further double-action jack having a movable piston rod acting directly on a first one of said two folding-over blades, said second folding-over blades being connected to an oscillating small connecting rod mounted to rotate about a fixed axis, and including a transmission arm mechanically connecting said movable rod to said connecting rod.

8. A device according to any one of claims 3 to 5, and including means, responsive to the instant at which said box blank feed jack reaches it said retracted position, for actuating said two folding-over blades to cause them to pass from a close position to a separated position.

9. A device according to claim 4 including means responsive to the instant at which the two folding-over blades reach their close relative position after having been in the separated relative position, for stopping the suction.

10. A device according to claim 6, including slide means carrying said closing means, and means to cause said slide means to undergo an alternating translational movement parallel to the axis of the forming slot.

11. A device according to claim 10, wherein said slide can assume two positions at the end of its stroke, namely a first position remote from the forming slot, and a second position close to the forming slot when said closing means substantially abut against the two folding-over blades.

12. A device according to claim 10, and including a control jack, which is operated at the instant at which the two folding-over blades for folding over the end flaps reach their close relative position, for operating said slide means.

13. A device according to claim 10, wherein said closing means comprise a fork having two arms which, when the slide means is in said close position, are located inside the forming slot and on either side of the two folding-over blades, the bottom of said fork having concave profile means which substantially abuts against the above-mentioned folding-over blades; said closing fork being effective to cause the end panel of a box, and its associated tab, to pivot in the clockwise direction to bring them into a position where the end panel is at a slight angle relative to a plane perpendicular to said forming slot, and where the said tab is substantially arranged opposite its slit for introduction into the case of said box.

14. A device according to claim 13, wherein said closing means further comprise pushing means which engage the end panel of a box to be closed when the closing fork abuts with its concave profile bottom against the two folding-over blades, for the purpose of introducing the flap into the case of the box.

15. A device according to claim 14, and wherein said means to cause said slide to undergo an alternating translational movement parallel to the axis of the forming slot include means slidably supporting said slide means; and further including spring means resisting movement of said closing fork relative to said slide means, the axis of movement of said closing fork relative to said slide means being parallel to the axis of movement of the slide means relative to said supporting means, and said pushing means being fixed onto said slide means.

16. A device according to claim 13, including a pair of guide arms defining side walls to said forming slot, the two arms of said closing fork comprising upper and lower arms substantially parallel and at right angles to said two guide arms, and the concave profile means of the closing fork consisting of concave profiled fins uniformly spaced apart from one another and connected at right angles to the upper arm of the fork; and further including co-planar strips which constitute said lower arm of the said fork and extend said fins parallel to said upper arm of the fork.

17. A device according to claim 14 wherein said pushing means are in the form of parallel teeth which are uniformly spaced apart from one another, said profiled fins of the closing fork being movable between said teeth, said profiled teeth defining opposite said slot a support surface which is substantially planar and runs at right angles to said two guide arms of the said forming slot.

18. A device according to claim 7 wherein the jack which controls the closing means is operated at the instant at which the two blades for folding over the end flaps reach their close relative position, whilst the jack which controls the two folding-over blades is operated so as to bring said folding-over blades from a close position to a separated position at the instant at which the jack which controls the closing means reaches its extended position.

19. A device according to claim 10, and including an ejector jack carried by said slide means, said ejector jack being effective to eject the boxes from the forming slot and being actuated after the box present inside the forming slot has been closed and after the said folding-over blades have been withdrawn from said forming slot.

20. A device according to claim 19, wherein said closing means are carried, relative to the forming slot, at the front of the slide means; and said ejector jack includes a piston rod carried at the rear of said slide means; and including means defining a passage in said closing means, said passage receiving slidably the piston rod of said ejector jack.

21. A device according to claim 19, wherein said closing means comprise a fork having first and second arms arranged substantially mutually perpendicular, said first arm running parallel to the axis of the forming slot and said second arm having an upper planar part at right angles to the axis of the forming slot and a lower part having a concave profile.

22. A device according to claim 21, wherein said planar upper part of the second arm of the fork is arranged to substantially abut against the folding-over blades in the close position at the instant of closing a box inside the forming slot, whilst said lower part effects pivoting in the clockwise direction of on the one hand the end panel of the erected box about its folding line which connects it to the upper panel of the case, and on the other hand the flap about its folding line which connects it to the said end panel.

23. A device according to claim 21, wherein said first arm of the closing fork is in the form of a thin blade which is effective to enter the interior of the box to be closed, through a slit formed between the two folded-over end flaps and the lower panel of the box, at the instant of the operation of closing the said box.

24. A device according to claim 19, wherein the ejector jack is actuated when said slide means is at the end of its stroke, after withdrawal of the two folding-over blades from the forming slot, and wherein said ejector jack has a movable piston rod having a stroke long enough to allow ejection of an erected and closed box from said forming slot.

* * * * *